US009797098B2

(12) United States Patent
Guilmette

(10) Patent No.: US 9,797,098 B2
(45) Date of Patent: Oct. 24, 2017

(54) AGGREGATE SPREADING SYSTEM

(71) Applicant: George Guilmette, Somersworth, NH (US)

(72) Inventor: George Guilmette, Somersworth, NH (US)

( * ) Notice: Subject to any disclaimer, the term of this patent is extended or adjusted under 35 U.S.C. 154(b) by 132 days.

(21) Appl. No.: 14/829,781

(22) Filed: Aug. 19, 2015

(65) Prior Publication Data

US 2017/0051460 A1 Feb. 23, 2017

(51) Int. Cl.

| | |
|---|---|
| ***E01C 19/12*** | (2006.01) |
| ***E01C 19/15*** | (2006.01) |
| ***E01C 19/48*** | (2006.01) |
| ***E02F 3/76*** | (2006.01) |
| *E01C 19/20* | (2006.01) |

(52) U.S. Cl.

CPC ..... *E01C 19/15* (2013.01); *E01C 19/4866* (2013.01); *E01C 19/4886* (2013.01); *E02F 3/7695* (2013.01); *E01C 2019/2075* (2013.01)

(58) Field of Classification Search

CPC ..... E01C 19/4886; E01C 2019/2075; E02F 3/7695

USPC ..... 404/101; 298/13, 7; 37/274, 281

See application file for complete search history.

(56) References Cited

U.S. PATENT DOCUMENTS 3,743,026 A * 7/1973 Gill ..... E02F 3/841 172/4.5
4,074,802 A * 2/1978 Hudis ..... B65G 41/005 198/315
4,096,652 A * 6/1978 Raines ..... E01H 5/063 37/105
4,357,766 A * 11/1982 Croteau ..... E01H 5/067 37/105
4,571,119 A * 2/1986 Jones ..... E01C 19/482 404/103
5,595,007 A * 1/1997 Biance ..... E01H 5/068 172/445.2
5,701,693 A * 12/1997 Brocious ..... E01H 1/003 172/305
6,089,785 A * 7/2000 Bergman ..... E01C 19/488 404/101
6,581,307 B1 * 6/2003 Jones ..... E01H 5/067 37/274
6,612,774 B1 * 9/2003 Dulin ..... E01C 19/266 404/104
6,659,376 B2 12/2003 Savard
6,962,490 B2 11/2005 Garden
7,107,710 B2 * 9/2006 Savard ..... E01H 5/067 37/274
7,182,549 B2 * 2/2007 Wiker ..... E01C 19/4873 404/101

(Continued)

*Primary Examiner* — Thomas B Will
*Assistant Examiner* — Katherine Chu

(57) ABSTRACT

An aggregate spreading system includes a dump truck that has a cab and a bed. The bed may contain an aggregate. A transport unit is coupled to the dump truck. The transport unit is positioned on the bed to urge the aggregate forwardly in the bed. A distribution unit is coupled to the dump truck. The distribution unit is positioned on the bed to receive the aggregate from the transport unit. Thus, the distribution unit distributes the aggregate onto a support surface. The distribution unit levels the aggregate on the support surface when the aggregate has been released onto the support surface.

12 Claims, 6 Drawing Sheets

(56) References Cited

U.S. PATENT DOCUMENTS

| | | | | |
|---|---|---|---|---|
| 7,523,569 | B2 * | 4/2009 | Savard | E01H 5/067 172/742 |
| 7,540,687 | B2 * | 6/2009 | Neumann | E01C 19/182 108/110 |
| 7,624,520 | B2 * | 12/2009 | Gordon | E02F 3/7609 172/815 |
| 7,686,537 | B2 * | 3/2010 | Mullett | E02F 3/7618 172/253 |
| 7,789,587 | B2 * | 9/2010 | James | E01H 1/003 172/172 |
| 8,297,879 | B1 | 10/2012 | Schmidt | |
| 8,732,990 | B1 * | 5/2014 | Danreuther | E01H 5/067 37/281 |
| 2010/0316444 | A1 | 12/2010 | Waldo | |
| 2011/0016756 | A1 * | 1/2011 | Schmidt | E02F 3/325 37/403 |
| 2014/0064848 | A1 * | 3/2014 | Engel | E01C 19/187 404/72 |

* cited by examiner

AGGREGATE SPREADING SYSTEM

BACKGROUND OF THE DISCLOSURE

Field of the Disclosure

The disclosure relates to spreading devices and more particularly pertains to a new spreading device for utilizing a truck to evenly distribute aggregate material along a road side.

SUMMARY OF THE DISCLOSURE

An embodiment of the disclosure meets the needs presented above by generally comprising a dump truck that has a cab and a bed. The bed may contain an aggregate. A transport unit is coupled to the dump truck. The transport unit is positioned on the bed to urge the aggregate forwardly in the bed. A distribution unit is coupled to the dump truck. The distribution unit is positioned on the bed to receive the aggregate from the transport unit. Thus, the distribution unit distributes the aggregate onto a support surface. The distribution unit levels the aggregate on the support surface when the aggregate has been released onto the support surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
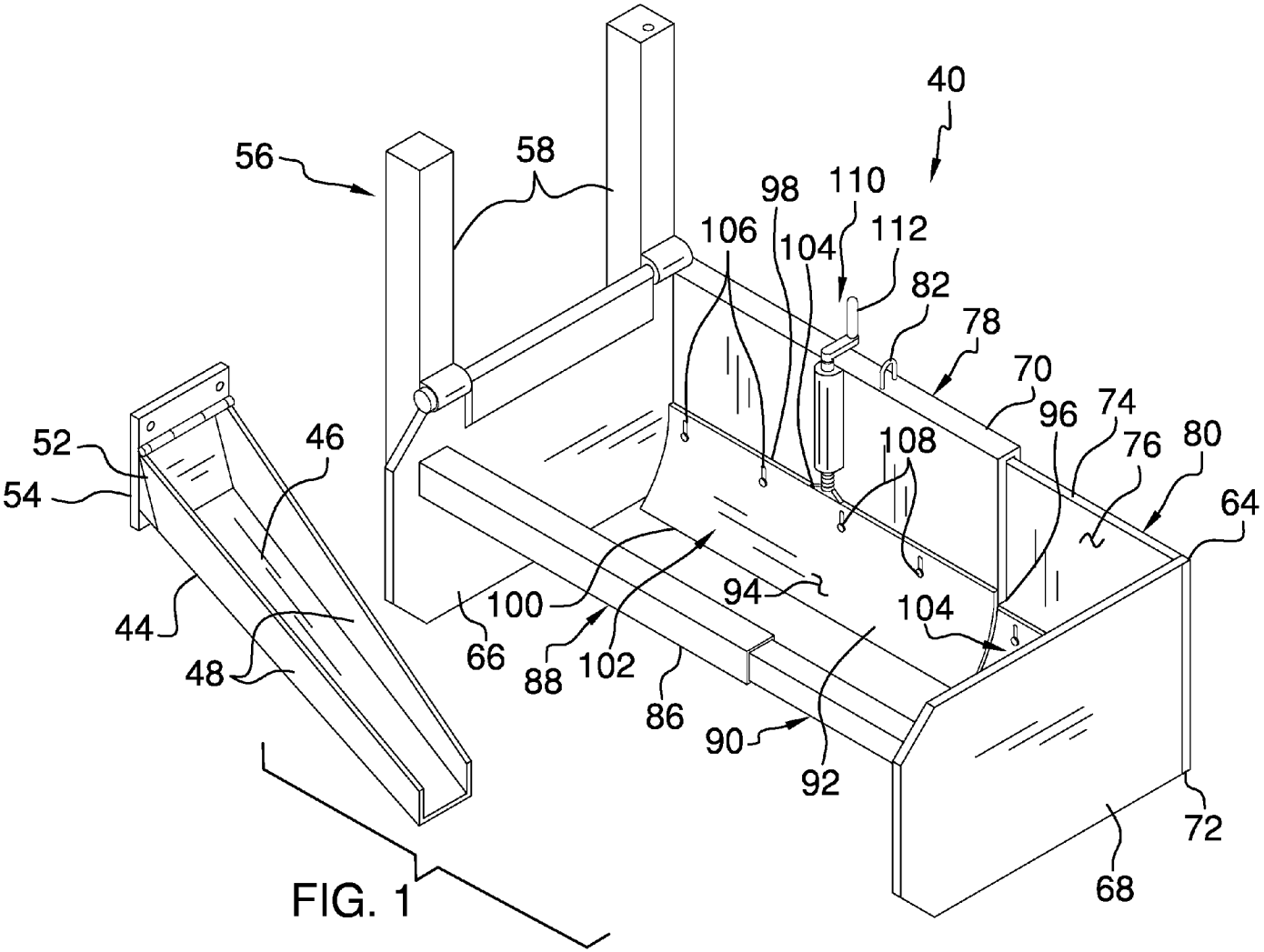
FIG. 1 is a perspective view of an aggregate spreading system according to an embodiment of the disclosure.
Figure 2:
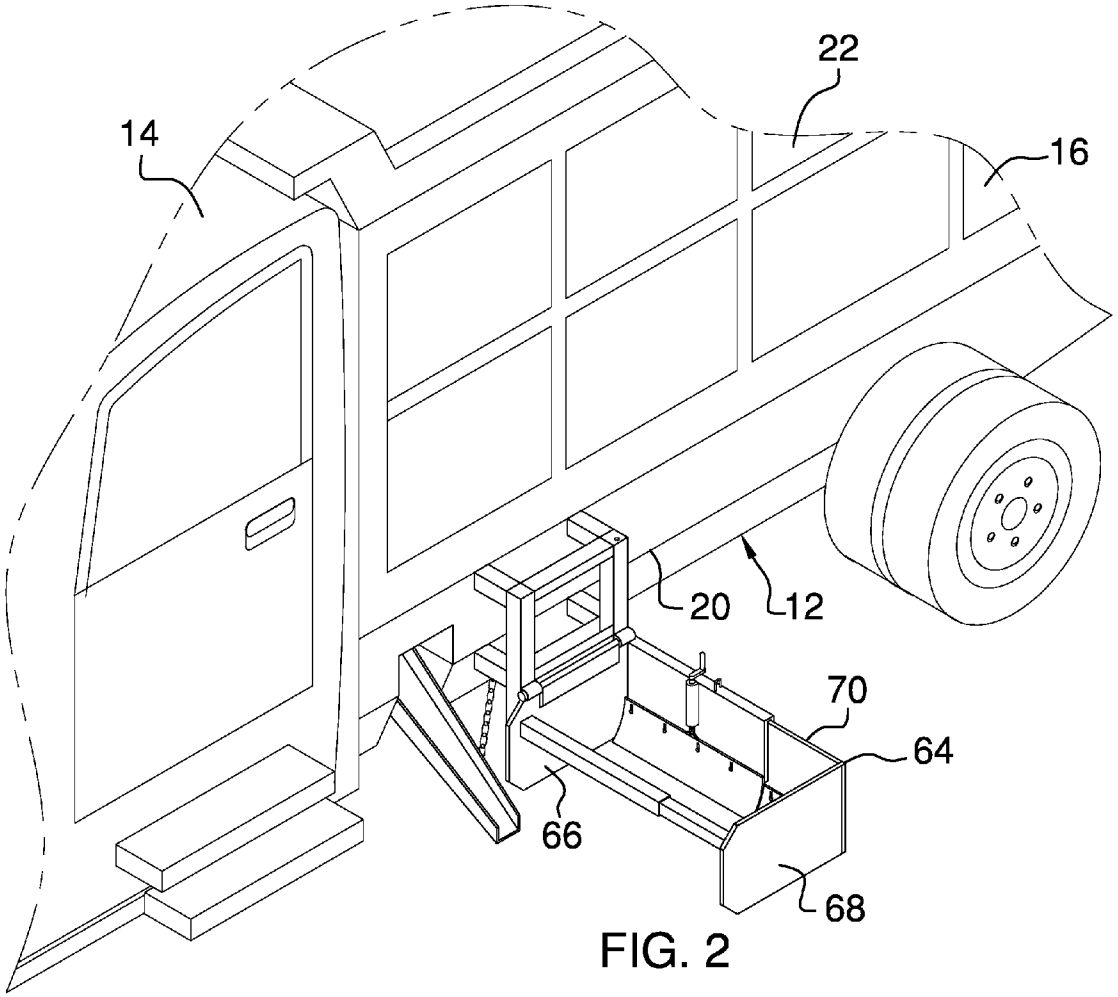
FIG. 2 is a perspective in-use view of an embodiment of the disclosure.
Figure 3:
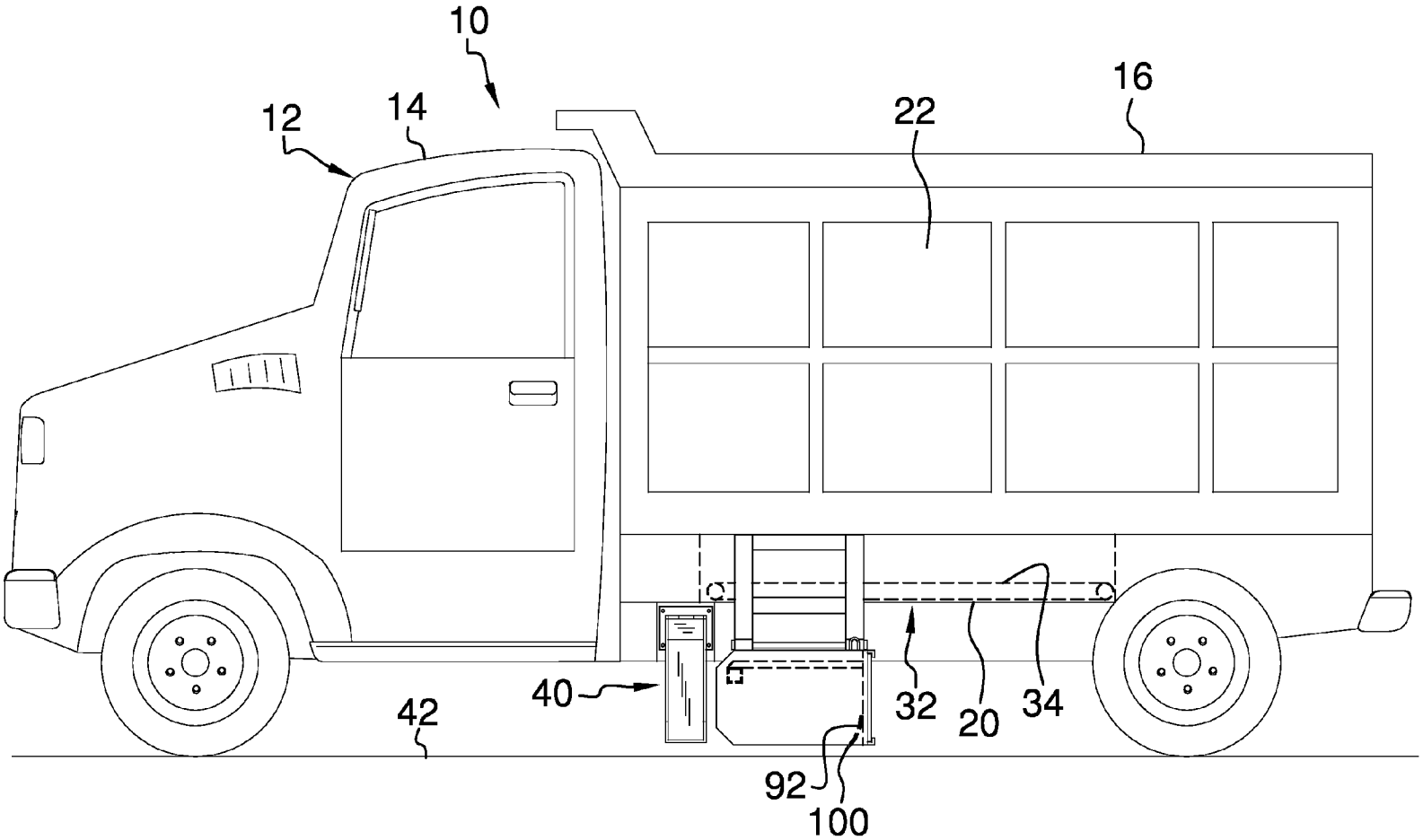
FIG. 3 is a left side phantom view of an embodiment of the disclosure.
Figure 4:
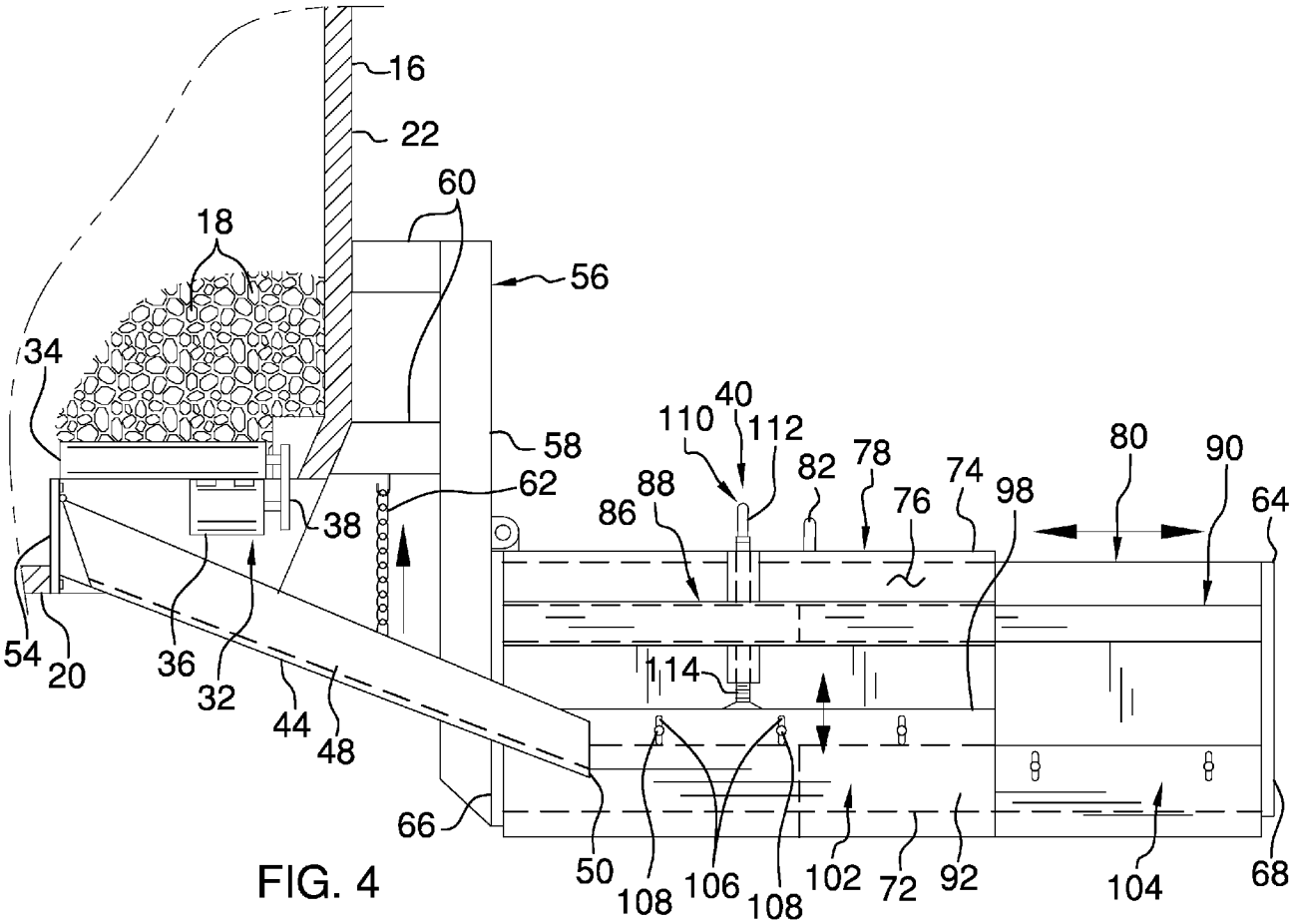
FIG. 4 is a front cutaway view of an embodiment of the disclosure.
Figure 5:
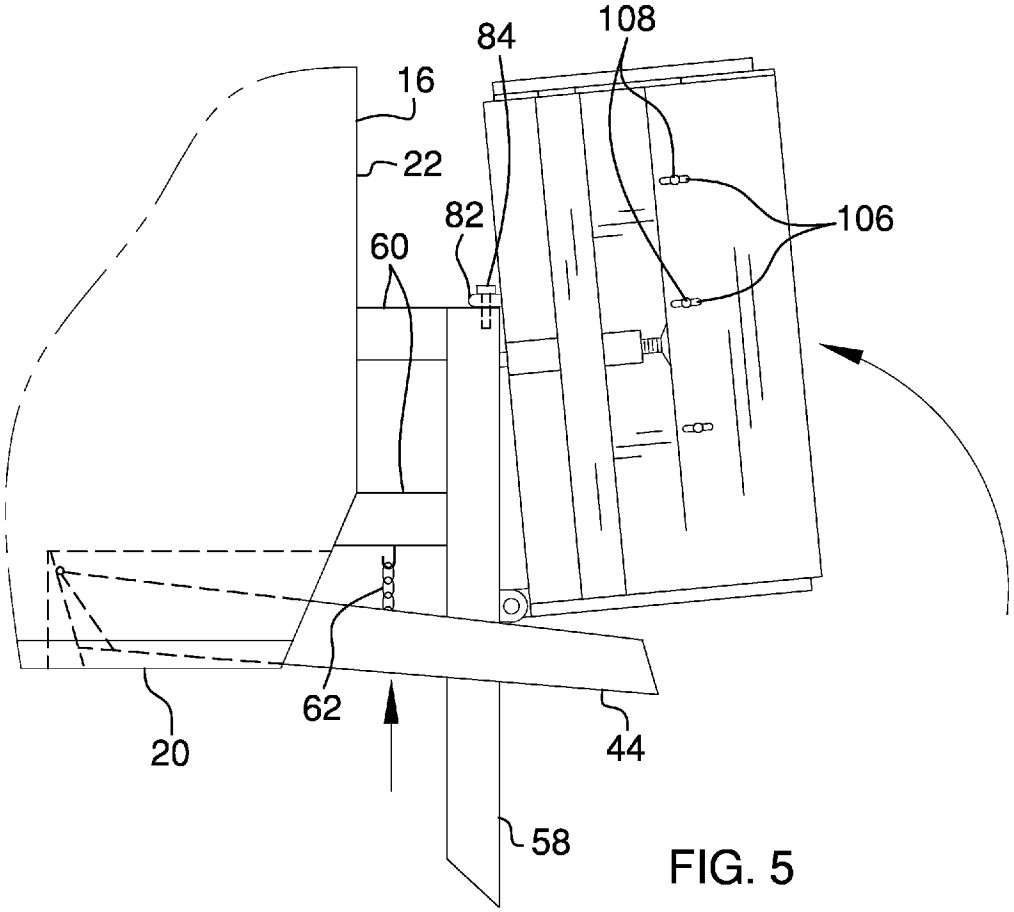
FIG. 5 is a front phantom view of an embodiment of the disclosure.
Figure 6:
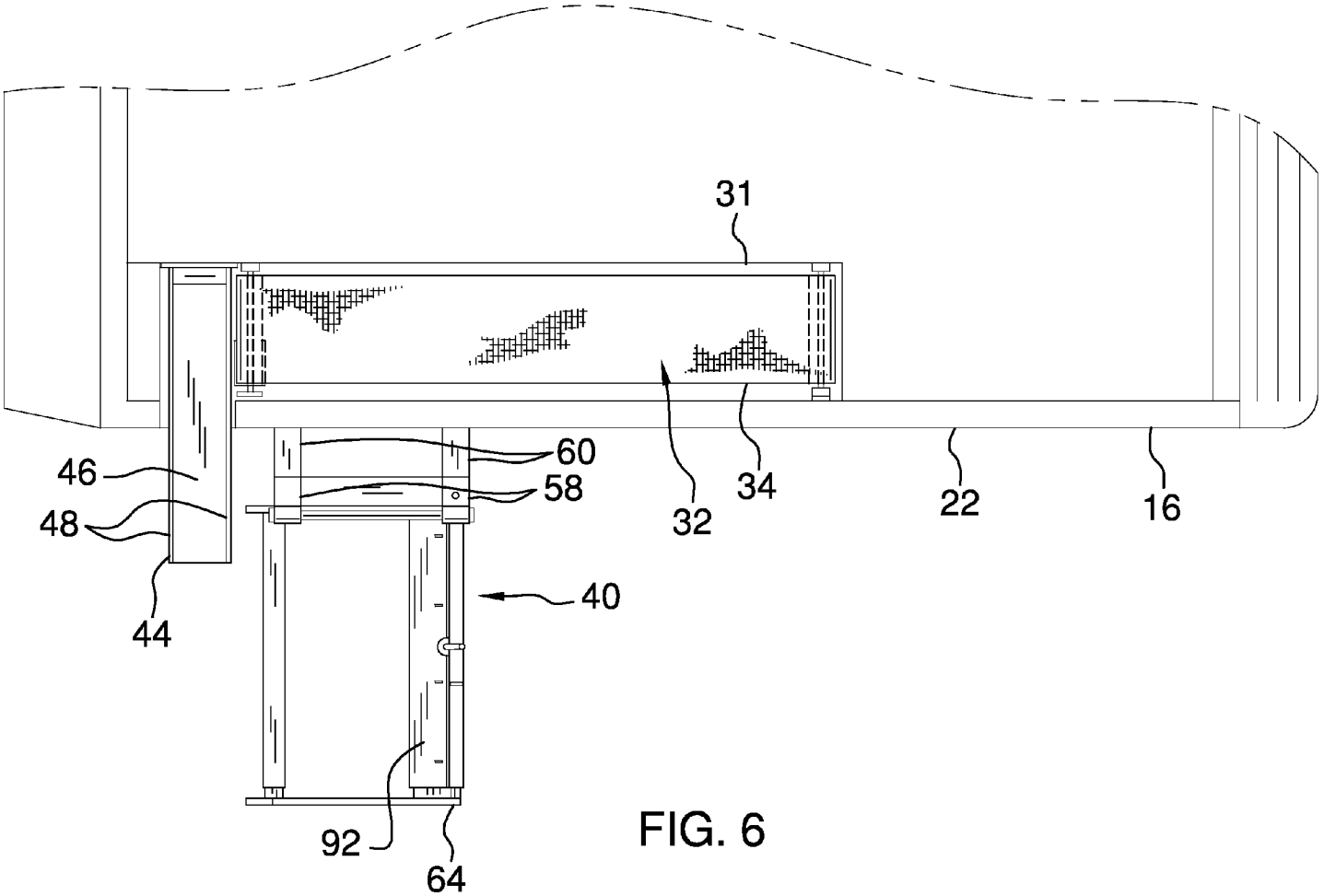
FIG. 6 is a top cutaway view of an embodiment of the disclosure.

With reference now to the drawings, and in particular to FIGS. 1 through 6 thereof, a new spreading device embodying the principles and concepts of an embodiment of the disclosure and generally designated by the reference numeral 10 will be described.

As best illustrated in FIGS. 1 through 6, the aggregate spreading system 10 generally comprises a dump truck 12 that has a cab 14 and a bed 16. The bed 16 may contain an aggregate 18 and the aggregate 18 may comprise gravel or the like. The bed 16 has a bottom wall 20 and a peripheral wall 22 extending upwardly from the bottom wall 20. The peripheral 22 wall has a first lateral side 24, a back side 26 and a front side 28. The first lateral side 24 has a well 30 extending inwardly therein. The bottom wall 20 has an opening 31 extending therethrough and the opening 31 is substantially coextensive with the first lateral side 24.

A transport unit 32 is coupled to the dump truck 12. The transport unit 32 is positioned on the bed 16 such that the transport unit 32 may urge the aggregate 18 forwardly in the bed 16. The transport unit 32 comprises a conveyor belt 34 that is positioned beneath the bottom wall 20. The conveyor belt 34 extends substantially between the front side 26 and the back side 28 and the conveyor belt 34 is aligned with the opening 31. Thus, the conveyor belt 34 is in communication with the aggregate 18.

A motor 36 is coupled to the bottom wall 20. The motor 36 is electrically coupled to the dump truck 12 such that the motor 36 is selectively turned on and off. A drive belt 38 is coupled between the motor 36 and the conveyor belt 34. The motor 36 rotates the drive belt 38 when the motor 36 is turned on. The drive belt 38 urges the conveyor belt 34 to rotate such that the conveyor belt 34 transports the aggregate 18 toward the front side 26. The motor 36 may be an electrical motor or the like.

A distribution unit 40 is coupled to the dump truck 12. The distribution unit 40 is positioned on the bed 16 such that the distribution unit 40 may receive the aggregate 18 from the transport unit 32. Thus, the distribution unit 40 distributes the aggregate 18 onto a support surface 42. The support surface 42 may be a roadway or the like. The distribution unit 40 levels the aggregate 18 on the support surface 42 when the aggregate 18 has been released onto the support surface 42.

The distribution unit 40 comprises a chute 44 that has a lower wall 46 and a pair of lateral walls 48. Each of the lateral walls 48 extends upwardly from the lower wall 46 and the lateral walls 48 are spaced from each other. The chute 44 has a front end 50 and a back end 52 and the front end 50 is open. The chute 44 includes a plate 54 that is hingedly coupled to the back end 52. The plate 54 is coupled to the bed 16 such that the chute 44 extends away from the first lateral side 24. The chute 44 is positioned proximate an intersection of the front side 28 and the first lateral side 24 such that the chute 44 is positioned within the well 30 in the bed 16.

The chute 44 is aligned with the conveyor belt 34 such that the conveyor belt 34 transports the aggregate 18 into the chute 44. Thus, the chute 44 releases the aggregate 18 outwardly through the front end 50 such that the aggregate 18 is deposited on the support surface 42. The chute 44 is positionable in a deployed position having the chute 44 angling downwardly from the bed 16. The chute 44 is positionable in a stored position having the chute 44 extending laterally away from the bed 16.

A mount 56 is provided and the mount 56 comprises a pair of longitudinal arms 58 and a plurality of lateral arms 60. Each of the lateral arms 60 is coupled to and extends away from the longitudinal arms 58. Each of the lateral arms 60 is coupled to the first lateral side 24 of the bed 16 such that the longitudinal arms 58 are spaced from the first lateral side 24. The mount 56 is positioned closer to the chute 44 than the back side 26 of the bed 16. A chain 62 is coupled between the chute 44 and the mount 56. The chain 62 retains the chute 44 at a selected angle with respect to the support surface 42.

A box 64 is provided and the box 64 includes a first lateral wall 66, a second lateral wall 68 and a rear wall 70 extending between the first lateral wall 66 and the second lateral wall 68. The box 64 has a bottom edge 72 and a top edge 74. Each of the first lateral wall 66 and the second lateral wall 68 extend forwardly from the rear wall 70. The first lateral wall 66 and the second lateral wall 68 are spaced from each other such that the box 64 has a U-shape. The rear wall 70 has a forward surface 76. The rear wall 70 has a first section 78 that is slidably coupled to a second section 80 such that the second lateral wall 68 is movable a selected distance away from the first lateral wall 66.

The first lateral wall 66 is hingedly coupled to the longitudinal arms 58 of the mount 56. The box 64 is positionable in a deployed position having the bottom edge 72 of the box 64 being coextensive with and being spaced from the support surface 42. The box 64 receives the aggregate 18 from the chute 44 when the box 64 is in the deployed position. The box 64 is positionable in a stored position having the box 64 extending upwardly along the first lateral side 24 of the bed 16.

A hook 82 is coupled to the top edge 74 corresponding to the first section 78. A fastener 84 is provided and the fastener 84 selectively engages one of the longitudinal arms 58 of the mount 56. The fastener 84 is extended through the hook 82 to engage the mount 56 when the box 64 is positioned in the stored position. Thus, the fastener 84 retains the box 64 in the stored position.

A support 86 is coupled to and extends between the first lateral wall 66 and the second lateral wall 68. The support 86 has a primary section 88 that is slidably coupled to a secondary section 90. Thus, that support 86 has a telescopically adjustable length. The support 86 is spaced from the rear wall 70 such that the support 86 inhibits the first lateral wall 66 from being urged toward the second lateral wall 68.

A blade 92 is provided that has a front surface 94, a back surface 96, a top edge 98 and a lower edge 100. The blade 92 is slidably coupled to the rear wall 70 such that the back surface 96 abuts the forward surface 76 of the rear wall 70. Thus, the blade 92 smoothes the aggregate 18 on the support surface 42 when dump truck 12 is driven along the support surface 42. Each of the front surface 94 and the back surface 96 is curved such that blade 92 curves forwardly between the top edge 98 and the lower edge 100. The blade 92 has a first portion 102 and a second portion 104. The first portion 102 is coupled to the first section 78 of the box 64. The second portion 104 is coupled to the second section 80 of the box 64 and the second portion 104 may have a height that is less than a height of the first portion 102.

The blade 92 has a plurality of slots 106 extending through the front surface 94 and the back surface 96. The slots 106 are spaced apart from each other and distributed along the blade 92. Each of the slots 106 is positioned adjacent to the top edge 98 of the blade 92. A plurality of pins 108 is coupled to the forward surface 76 of the rear wall 70. The pins 108 are space apart from each other and are distributed along the rear wall 70. Each of the pins 108 is aligned with an associated one of the slots 106. Each of the pins 108 extends through the associated slot 106 such that the blade 92 is slidably retained on the rear wall 70.

A crank 110 is coupled to the rear wall 70 of the box 64. The crank 110 includes a handle 112 and a screw 114. The screw 114 is coupled to the top edge 98 corresponding to the first portion 102 of the blade 92. The screw 114 raises and lowers the first portion 102 of the blade 92 when the handle 112 is manipulated. Thus, the blade 92 smoothes the aggregate 18 to a selected thickness on the support surface 42.

In use, the chute 44 is positioned in the deployed position and the box 64 is positioned in the deployed position. The crank 110 is manipulated to position the first portion 102 of the blade 92 at the selected height with respect to the support surface 42. The dump truck 12 is driven and the motor 36 is turned on to release the aggregate 18 onto the support surface 42. The blade 92 smoothes the aggregate 18 to the selected thickness while the dump truck 12 is driven along the support surface 42. The chute 44 is positioned in the stored position and the box 64 is positioned in the stored position when the aggregate 18 is not being distributed onto the support surface 42.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An aggregate spreading system comprising:

a dump truck having a cab and a bed, said bed being configured to contain an aggregate, said bed having a bottom wall and a peripheral wall extending upwardly from said bottom wall, said peripheral wall having a first lateral side, a back side and a front side;

a transport unit being coupled to said dump truck, said transport unit being positioned on said bed wherein said transport unit is configured to urge the aggregate forwardly in said bed; and a distribution unit being coupled to said dump truck, said distribution unit being positioned on said bed wherein said distribution unit is configured to receive the aggregate from said transport unit thereby facilitating said distribution unit to distribute the aggregate onto a support surface, said distribution unit being configured to level the aggregate on the support surface when the aggregate has been released onto the support surface, said distribution unit further comprising a box including a first lateral wall, a second lateral wall and a rear wall extending between said first lateral wall and said second lateral wall, said box having a bottom edge, each of said first lateral wall and said second lateral wall extending forwardly from said rear wall, said first lateral wall and said second lateral wall being spaced from each other such that said box has a U-shape, said rear wall having a forward surface, and a support being coupled to and extending between said first lateral wall and said second lateral wall, said support having a primary section being slidably coupled to a secondary section such that support has a telescopically adjustable length, said support being spaced from said rear wall such that said support inhibits said first lateral wall from being urged toward said second lateral wall.

2. The system according to claim 1, wherein said transport unit comprises a conveyor belt being positioned on said bottom wall wherein said conveyor belt is configured to be in communication with the aggregate, said conveyor belt extending substantially between said front side and said back side, said conveyor belt being aligned with said first lateral side.

3. The system according to claim 2, wherein said transport unit further comprises a motor being coupled to said bottom wall, said motor being electrically coupled to said dump truck such that said motor is selectively turned on and off.

4. The system according to claim 3, wherein said transport unit further comprises a drive belt being coupled between said motor and said conveyor belt, said motor rotating said drive belt when said motor is turned on, said drive belt urging said conveyor belt to rotate toward said front side wherein said conveyor belt is configured to transport the aggregate toward said front side.

5. The system according to claim 1, wherein said distribution unit comprises a chute having a lower wall and a pair of lateral walls, each of said lateral walls extending upwardly from said lower wall, said lateral walls being spaced from each other, said chute having a front end and a back end, said front end being open.

6. The system according to claim 5, wherein:

said transport unit includes a conveyor belt;

said chute includes a plate being hingedly coupled to said back side, said plate being coupled to said bed such that said chute extends away from said first lateral side, said chute being positioned proximate an intersection of said front side and said first lateral side, said chute being aligned with said conveyor belt wherein said conveyor belt is configured to transport the aggregate into said chute thereby facilitating said chute to release the aggregate outwardly through said front end; and said chute being positionable in a deployed position having said chute angling downwardly from said bed, said chute being positionable in a stored position having said chute extending laterally away from said bed.

7. The system according to claim 1, wherein said distribution unit further comprises a mount comprising a pair of longitudinal arms and a plurality of lateral arms, each of said lateral arms being coupled to and extending away from said longitudinal arms, each of said lateral arms being coupled to said first lateral side of said bed such that said longitudinal arms are spaced from said first lateral side, said mount being positioned closer to a chute than said back side of said bed.

8. An aggregate spreading system comprising:

a dump truck having a cab and a bed, said bed being configured to contain an aggregate, said bed having a bottom wall and a peripheral wall extending upwardly from said bottom wall, said peripheral wall having a first lateral side, a back side and a front side;

a transport unit being coupled to said dump truck, said transport unit being positioned on said bed wherein said transport unit is configured to urge the aggregate forwardly in said bed;

a distribution unit being coupled to said dump truck, said distribution unit being positioned on said bed wherein said distribution unit is configured to receive the aggregate from said transport unit thereby facilitating said distribution unit to distribute the aggregate onto a support surface, said distribution unit being configured to level the aggregate on the support surface when the aggregate has been released onto the support surface, said distribution unit further comprising a box including a first lateral wall, a second lateral wall and a rear wall extending between said first lateral wall and said second lateral wall, said box having a bottom edge, each of said first lateral wall and said second lateral wall extending forwardly from said rear wall, said first lateral wall and said second lateral wall being spaced from each other such that said box has a U-shape, said rear wall having a forward surface;

said distribution unit including a mount and a chute, said mount having a pair of longitudinal arms;

said rear wall having a first section being slidably coupled to a second section such that said second lateral wall is movable a selected distance away from said first lateral wall, said first lateral wall being hingedly coupled to said longitudinal arms of said mount; and said box being positionable in a deployed position having said bottom edge of said box being coextensive with and being spaced from the support surface wherein said box is configured to receive the aggregate from said chute, said box being positionable in a stored position having said box extending upwardly along said first lateral side of said bed.

9. The system according to claim 1, wherein said distribution unit further comprises a blade having a front surface, a back surface, a top edge and a lower edge, said blade being slidably coupled to said rear wall such that said back surface abuts said forward surface of said rear wall wherein said blade is configured to smooth the aggregate on the support surface when dump truck is driven along the support surface, each of said front surface and said back surface being curved such that blade curves forwardly between said top edge and said lower edge.

10. The system according to claim 9, wherein:

said rear wall has a first section and a second section; and said blade has a first portion and a second portion, said first portion being coupled to said first section of said rear wall, said second portion being coupled to said second section of said rear wall.

11. The system according to claim 10, wherein said distribution unit further comprises a crank being coupled to said rear wall of said box, said crank including a handle and a screw, said screw being coupled to said top edge corresponding to said first portion of said blade such said screw raises and lowers said first portion when said handle is manipulated wherein said blade is configured to smooth the aggregate to a selected thickness on the support surface.

12. An aggregate spreading system comprising:

a dump truck having a cab and a bed, said bed being configured to contain an aggregate, said bed having a bottom wall and a peripheral wall extending upwardly from said bottom wall, said peripheral wall having a first lateral side, a back side and a front side;

a transport unit being coupled to said dump truck, said transport unit being positioned on said bed wherein said transport unit is configured to urge the aggregate forwardly in said bed, said transport unit comprising:

a conveyor belt being positioned on said bottom wall wherein said conveyor belt is configured to be in communication with the aggregate, said conveyor belt extending substantially between said front side and said back side, said conveyor belt being aligned with said first lateral side, a motor being coupled to said bottom wall, said motor being electrically coupled to said dump truck such that said motor is selectively turned on and off, and a drive belt being coupled between said motor and said conveyor belt, said motor rotating said drive belt when said motor is turned on, said drive belt urging said conveyor belt to rotate toward said front side wherein said conveyor belt is configured to transport the aggregate toward said front side; and a distribution unit being coupled to said dump truck, said distribution unit being positioned on said bed wherein said distribution unit is configured to receive the aggregate from said transport unit thereby facilitating said distribution unit to distribute the aggregate onto a support surface, said distribution unit being configured to level the aggregate on the support surface when the aggregate has been released onto the support surface, said distribution unit comprising:

a chute having a lower wall and a pair of lateral walls, each of said lateral walls extending upwardly from said lower wall, said lateral walls being spaced from each other, said chute having a front end and a back end, said front end being open, said chute including a plate being hingedly coupled to said back side, said plate being coupled to said bed such that said chute extends away from said first lateral side, said chute being positioned proximate an intersection of said front side and said first lateral side, said chute being aligned with said conveyor belt wherein said conveyor belt is configured to transport the aggregate into said chute thereby facilitating said chute to release the aggregate outwardly through said front end, said chute being positionable in a deployed position having said chute angling downwardly from said bed, said chute being positionable in a stored position having said chute extending laterally away from said bed, a mount comprising a pair of longitudinal arms and a plurality of lateral arms, each of said lateral arms being coupled to and extending away from said longitudinal arms, each of said lateral arms being coupled to said first lateral side of said bed such that said longitudinal arms are spaced from said first lateral side, said mount being positioned closer to said chute than said back side of said bed, a box including a first lateral wall, a second lateral wall and a rear wall extending between said first lateral wall and said second lateral wall, said box having a bottom edge, each of said first lateral wall and said second lateral wall extending forwardly from said rear wall, said first lateral wall and said second lateral wall being spaced from each other such that said box has a U-shape, said rear wall having a forward surface, said rear wall having a first section being slidably coupled to a second section such that said second lateral wall is movable a selected distance away from said first lateral wall, said first lateral wall being hingedly coupled to said longitudinal arms of said mount, said box being positionable in a deployed position having said bottom edge of said box being coextensive with and being spaced from the support surface wherein said box is configured to receive the aggregate from said chute, said box being positionable in a stored position having said box extending upwardly along said first lateral side of said bed, a support being coupled to and extending between said first lateral wall and said second lateral wall, said support having a primary section being slidably coupled to a secondary section such that support has a telescopically adjustable length, said support being spaced from said rear wall such that said support inhibits said first lateral wall from being urged toward said second lateral wall, a blade having a front surface, a back surface, a top edge and a lower edge, said blade being slidably coupled to said rear wall such that said back surface abuts said forward surface of said rear wall wherein said blade is configured to smooth the aggregate on the support surface when dump truck is driven along the support surface, each of said front surface and said back surface being curved such that blade curves forwardly between said top edge and said lower edge, said blade having a first portion and a second portion, said first portion being coupled to said first section of said box, said second portion being coupled to said second section of said box, and a crank being coupled to said rear wall of said box, said crank including a handle and a screw, said screw being coupled to said top edge corresponding to said first portion of said blade such said screw raises and lowers said first portion when said handle is manipulated wherein said blade is configured to smooth the aggregate to a selected thickness on the support surface.

* * * * *